United States Patent [19]

Thompson

[11] Patent Number: 4,507,052

[45] Date of Patent: Mar. 26, 1985

[54] END SEAL FOR TURBINE BLADE BASES

[75] Inventor: Douglas K. Thompson, Speedway, Ind.

[73] Assignee: General Motors Corporation, Detroit, Mich.

[21] Appl. No.: 480,831

[22] Filed: Mar. 31, 1983

[51] Int. Cl.[3] ..... F01D 5/30

[52] U.S. Cl. ..... 416/193 A; 416/95; 416/220 R

[58] Field of Search ..... 416/220 R, 95, 193 A, 416/221

[56] References Cited

U.S. PATENT DOCUMENTS

| | | | |
|---|---|---|---|
| 2,755,063 | 7/1956 | Wilkinson | 416/220 R X |
| 2,988,325 | 6/1961 | Dawson | 416/95 X |
| 3,096,074 | 7/1963 | Pratt et al. | 416/221 X |
| 3,455,537 | 7/1969 | Kozlin et al. | 416/220 X |
| 3,572,966 | 3/1971 | Borden et al. | 416/95 |
| 3,644,058 | 2/1972 | Barnabei et al. | 416/220 X |
| 3,768,924 | 10/1973 | Corsmeier et al. | 416/220 X |
| 3,814,539 | 6/1974 | Klompas | 416/220 X |
| 3,853,425 | 12/1974 | Scalzo et al. | 416/95 |
| 4,021,138 | 5/1977 | Scalzo et al. | 416/193 A X |
| 4,247,257 | 1/1981 | Benoist et al. | 416/221 |

FOREIGN PATENT DOCUMENTS

| | | | |
|---|---|---|---|
| 589462 | 12/1959 | Canada | 416/221 |
| 2841793 | 7/1979 | Fed. Rep. of Germany | 416/220 R |
| 779059 | 7/1957 | United Kingdom | 416/221 |
| 947553 | 1/1964 | United Kingdom | 416/95 |

*Primary Examiner*—Everette A. Powell, Jr.
*Attorney, Agent, or Firm*—Saul Schwartz

[57] ABSTRACT

An end seal for cooling air manifolds below the bases of a stage of air cooled turbine blades on a turbine wheel, the end seal including a seal ring having an annular planar portion abutting an end face of the turbine wheel inboard of the air manifolds and a right cylindrical flange perpendicular to the planar portion and underlying a corresponding cylindrical shoulder on the wheel and on the blade bases outboard of the air manifolds, and a plurality of end plates on the wheel having lugs underlying the cylindrical flange. The planar portion is axially clamped to the wheel to define a 360° inboard seal while centrifugal forces developed by the end plates during rotation of the wheel cause the lugs to radially clamp the cylindrical flange against the cylindrical shoulder on the wheel and blade bases to define a 360° outboard seal.

3 Claims, 2 Drawing Figures

END SEAL FOR TURBINE BLADE BASES

BACKGROUND OF THE INVENTION

1. Field of the Invention

This invention relates generally to gas turbine engine rotors having air cooled turbine blades and, more particulary, to end seals at the turbine blade bases.

2. Description of the Prior Art

With more emphasis on fuel economy and more extensive use of air cooled turbine blades, minimizing the loss of cooling air from blade delivery circuits is an important design consideration. One very difficult area to seal is the turbine blade-turbine wheel attachment interface. Typically, cooling air is delivered into a clearance slot or manifold in the wheel inboard of the individual blade attachments from which it flows into the blade internal cooling cavities. The typical fir tree attachment on the blade base fits snugly into the wheel lugs and under centrifugal loading seals tightly against leakage. However, due to manufacturing tolerances the axial length of the blade base and wheel may differ from blade to blade and wheel to wheel. The result is leakage at the end of the air manifold between the blade or wheel and the cover plate normally installed to prevent such leakage. An end seal according to this invention reduces cooling air loss attributable to manufacturing tolerances between the blade base and the turbine wheel.

SUMMARY OF THE INVENTION

Figure 1:
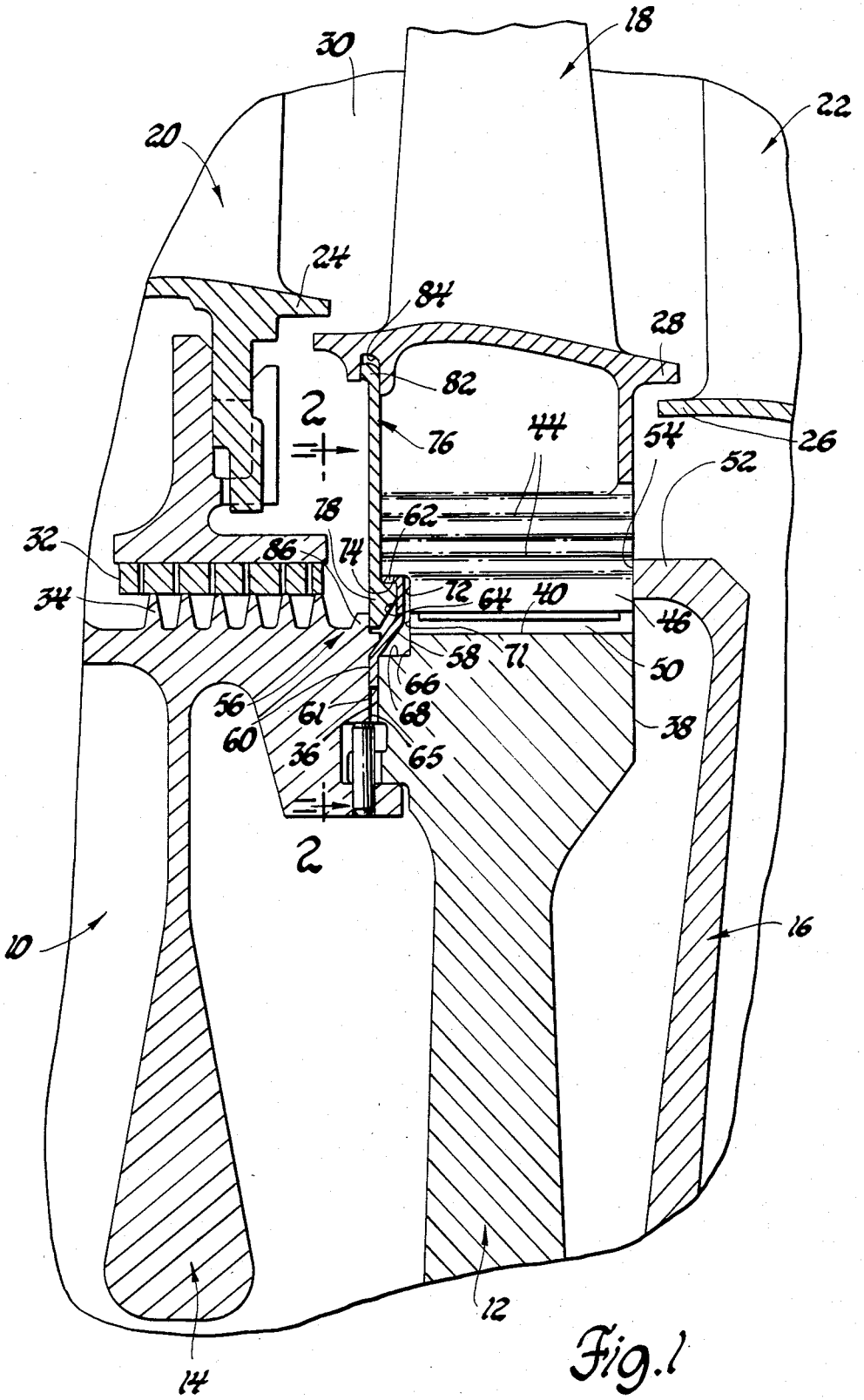
Figure 2:
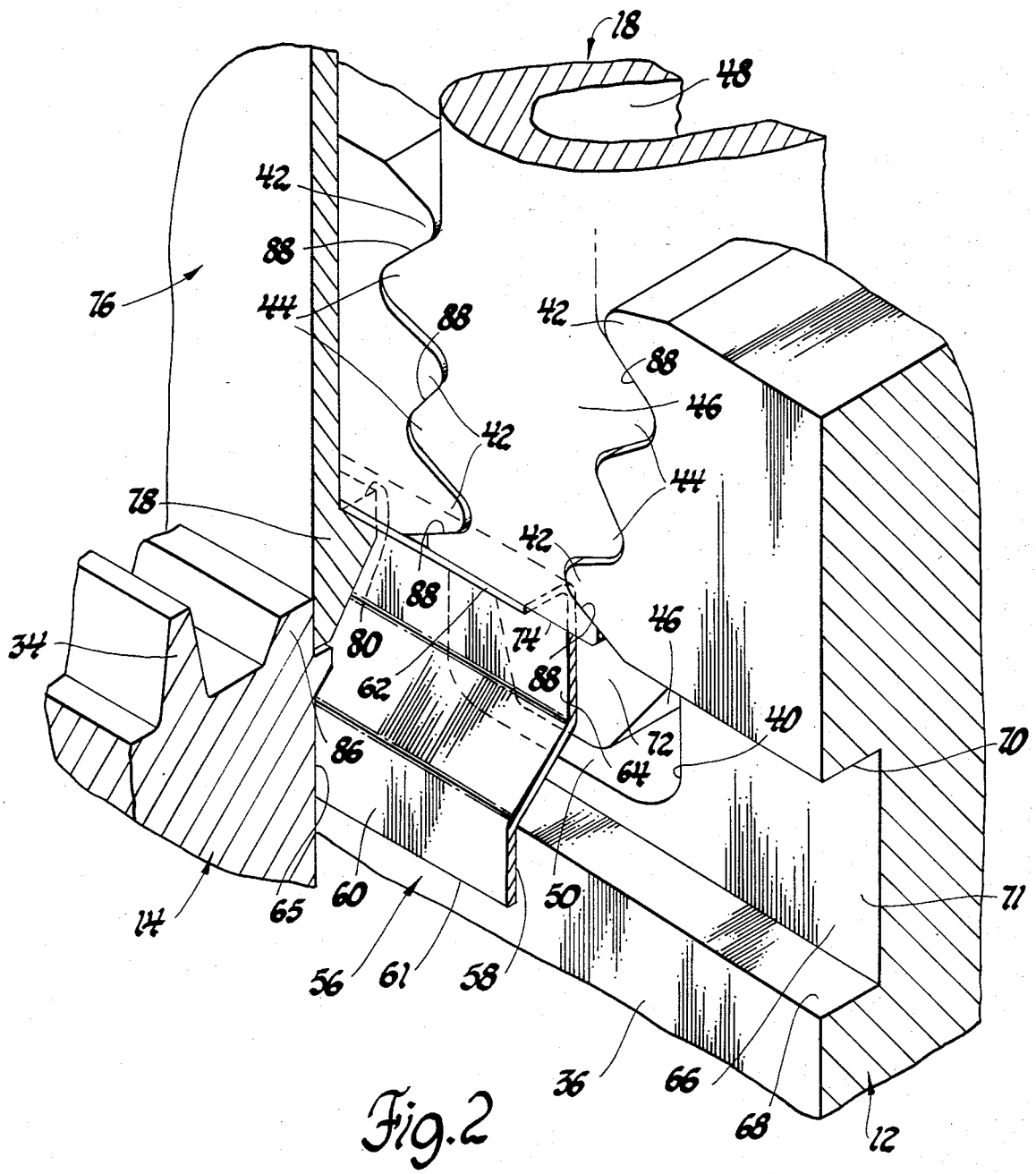

Accordingly, the primary feature of this invention is that it provides a new and improved end seal at the base of an air cooled turbine blade which minimizes cooling air leakage due to differences between the axial lengths of the turbine blades and the turbine wheel resulting from manufacturing tolerances. Another feature of this invention resides in the provision in the new and improved end seal of a disc which overlaps the bases of the air cooled blades and in the provision of axial clamping means for clamping the disc against the side of the turbine wheel to effect a 360° inboard seal and centrifugally actuated radial clamping means for clamping the disc to the turbine wheel and to the individual blade bases to effect a 360° outboard seal. Still another feature of this invention resides in the provision in the new and improved end seal of a disc having an annular planar portion for sealing against the side of the turbine wheel and an integral right circular flange underlying a cylindrical shoulder on the turbine wheel and corresponding shoulders on each of the turbine blade bases and in the provision of end plates with lugs underlying the cylindrical flange which lugs press the flange against the wheel and the blade bases under the influence of centrifugal force as the wheel rotates. These and other features of this invention will be readily apparent from the following specification and from the drawings wherein:

FIG. 1 is a fragmentary elevational view, partly in section, of a gas turbine rotor including air cooled turbine blades and an end seal according to this invention; and FIG. 2 is a partially broken away perspective view taken generally along the plane indicated by lines 2—2 in FIG. 1 and showing the end seal according to this invention.

Referring now to FIG. 1 of the drawings, a gas turbine engine rotor 10 includes a turbine wheel 12, a spacer 14, and an aft cover plate 16. The turbine wheel

12 carries a plurality of air cooled turbine blades forming one stage of turbine blades of the engine, only a single turbine blade 18 being illustrated in FIGS. 1 and 2, which stage of blades is disposed between an upstream stage of stator vanes 20 and a downstream stage of stator vanes 22. The stator vanes 20 are mounted on a casing, not shown, of the gas turbine engine and direct motive fluid at the turbine blades while the stator vanes 22 are similarly mounted on the casing and direct the motive fluid at the next succeeding stage of turbine blades, not shown. Each of the stator vanes 20 includes a platform 24 and each of the stator vanes 22 includes a platform 26 which platforms cooperate with corresponding platforms on the turbine blades, such as a platform 28 on blade 18, in defining a motive fluid path designated generally 30. An abradable seal 32 on the stage of stator vanes 20 cooperates with a plurality of circumferential ridges 34 on the spacer 14 in defining a seal across the stage.

Referring now to both FIGS. 1 and 2, the turbine wheel 12 has an annular upstream face 36 in a transverse plane perpendicular to the axis of rotation of the rotor, an annular downstream face 38 in a similar transverse plane, and a plurality of circumferentially spaced blade retention slots, represented by a retention slot 40, oriented generally axially between the upstream and downstream faces. The slot 40 is of well known fir tree configuration and includes a plurality of axially extending lugs 42 arranged in pairs on opposite sides of the slot which becomes progressively narrower in the radial inward direction. The lugs 42 receive therebetween a corresponding plurality of lugs 44 on a fir tree base 46 of the turbine blade 18, the base 46 being slidably inserted into the retention slot 40 through either of the upstream or downstream faces 36 and 38, respectively.

The turbine blade 18 is air cooled and includes a schematically represented internal passage 48, FIG. 2, which communicates with the motive fluid path 30 and a space 50 between the bottom or radially innermost extremity of the slot 40 and the radially innermost extremity of the base 46, the space 50 being denominated herein as the cooling air manifold. The aft cover plate 16 includes a peripheral flange 52 having an annular face 54 which axially abuts the downstream face 38 of the turbine wheel and blades radially outboard of the cooling air manifold 50 and provides a tight seal against the downstream face. The blades 18 are pushed rearward by aerodynamic pressure back into intimate contact with the aft cover plate face 54 to assure a good seal between the blades and cover plate. The space between aft cover plate 16 and turbine wheel 12 is pressurized by the relatively cool air from the compressor of the engine which cool air circulates into the air manifold 50 from the downstream face 38, through the internal passages of the turbine blade 18, and then into the motive fluid path 30. During passage through the turbine blade, the cooling air maintains the turbine blade at a temperature consistent with maximum blade durability. An end seal according to this invention and designated generally 56 is located at the opposite end of the manifold 50 to prevent escape of cooling air at the upstream face 36 of the turbine wheel.

The end seal 56 includes a seal ring 58 having an annular planar portion 60 disposed in a transverse plane perpendicular to the axis of rotation of the rotor and defining an inside diameter 61 of the seal ring, a right cylindrical flange 62 perpendicular to the plane of planar portion 60, and an annular channel portion 64 integral with and interconnecting the planar portion 60 and the flange 62. The planar portion 60 is tightly captured between the upstream face 36 of the wheel 12 and a side 65 of the spacer 14, the spacer and wheel being urged together as part of the construction of the rotor itself. In order to accommodate the flange 62 and the channel portion 64, the turbine wheel 12 has formed in the upstream face 36 thereof an annular groove 66 having an inboard edge 68 at a radial distance from the axis of rotation of the rotor less than the radial distance to the bottom of the groove 40, an outboard edge 70, and a bottom 71. The base 46 of the turbine blade 18, as well as the corresponding bases of the other turbine blades in the stage, is relieved to maintain the continuity of the groove 66 across the base, the relief providing a transverse face 72 corresponding generally to the bottom 71 of groove 66 and a shoulder 74 perpendicular to the transverse face and corresponding generally to the outboard edge 70 of the groove.

With continued reference to FIGS. 1 and 2, the end seal 56 further includes a plurality of end plates at the upstream face 36 of the turbine wheel, only a single end plate 76 being shown in the Figures. The end plate 76 is a segment of an annulus spanning a plurality of the turbine blade bases and includes an integral inner lug 78, an annular shoulder 80 on the lug 78, and an outer edge 82. The end plate 76 abuts the upstream face 36 of the turbine wheel with the lug 78 projecting into the channel 64 in the seal ring and the annular shoulder 80 underlying the flange 62 and with the outer edge 82 disposed in appropriate grooves in the turbine blades below the platforms, a groove 84 in the turbine blade 18 being representative, which grooves cooperate in defining an annulus extending around the wheel. The end plate 76 is generally loosely captured in the groove 84 and behind an upstanding retainer 86 on the spacer 14 so that the end plate is free to move radially outward through limited displacement.

Describing now the operation of the end seal 56, when the gas turbine engine is in operation motive fluid flows downstream in the fluid path 30 and is directed against the turbine blade stage of wheel 12 causing the latter to rotate at high speed. The turbine blade 18 is retained on the wheel by interengagement between the lugs 42 on the wheel and the lugs 44 on the blade base along a plurality of lines of contact 88, FIG. 2, extending between the upstream and downstream faces 36 and 38, respectively. Because of the magnitude of the centrifugal force developed by the blade 18, the lines of contact 88 form essentially air-tight seals so that the air manifold 50 is sealed longitudinally on opposite sides of the slot 40 at the radially innermost lines of contact 88.

At the upstream face 36 of the turbine wheel the planar portion 60 of the seal ring 58 is tightly axially clamped between the turbine wheel upstream face and the surface 65 of the spacer 14. Because the planar portion 60 engages the upstream face 36 through a full 360° of contact radially inboard of the innermost extremity of slot 40, an inboard airtight seal preventing escape of cooling air from slot 40 around the planar portion is provided. As seen best in FIG. 2, the radial distance from the axis of rotation of the rotor to the outboard edge 70 of the groove 66 and the shoulder 74 on the blade base 46 at least equals the radial distance to the innermost lines of contact 88 between the lugs 44 and 42 on the base and the turbine wheel, respectively. The flange 62 of the seal ring 58, underlying the outboard edge 70 and the shoulder 74, is radially clamped against the outboard edge and the shoulder by the annular shoulder 80 on the end plate 76 which is urged radially outward under the influence of centrifugal force. The centrifugal force developed by the end plate 76 is substantial so that the flange 62 is very tightly pressed against the shoulder 74 and the outboard edge 70 thereby defining an outboard seal across the slot 40 and radially outboard of the manifold 50. The end plate 76, in addition to centrifugally energizing the lug 78 to press the shoulder 80 against the flange 62, also prevents axial passage of motive fluid across the turbine wheel below the platform 28 which could occur due to the pressure drop across the turbine blade stage.

It will be apparent that the foregoing description assumes complete and intimate contact between the flange 62 and the shoulder 74 on the base 46. However, because manufacturing tolerances are inherent, it may be necessary to locally deform the flange 62 to more fully follow the contour of the shoulder 74 across the slot 40. Regardless, however, the very substantial centrifugal loading imposed by the end plate 76 through the lug 78 and the shoulder 80 will press the flange against the shoulder 74 and the outboard edge 70 to, at least, significantly reduce cooling air leakage from the air manifold 50.

The embodiments of the invention in which an exclusive property or privilege is claimed are defined as follows:

1. In a gas turbine rotor assembly including a wheel having a circumferential array of retention slots and a plurality of air cooled blades having bases disposed in respective ones of said retention slots, said bases cooperating with said respective ones of said slots in defining a plurality of manifolds supplied with pressurized air from a first side of said wheel, an end seal for each of said manifolds at a second side of said wheel comprising, a seal ring having an annular planar portion and a cylindrical flange radially, outboard of and perpendicular to said planar portion, means for axially clamping said seal ring planar portion against said second side of said wheel with a circle of contact radially inboard of each of said slots so that a 360° inboard seal is defined, means on said wheel and on each of said blade bases defining a continuous radially inwardly facing cylindrical shoulder disposed radially outboard of each of said manifolds, said flange being disposed radially inboard of and adjacent said cylindrical shoulder, and centrifugal clamp means on said wheel engageable on said flange under the influence of centrifugal force during rotation of said wheel to radially clamp said flange against said cylindrical shoulder and thereby provide a 360° seal radially outboard of each of said manifolds.

2. In a gas turbine rotor assembly including a wheel having a circumferential array of retention slots and a plurality of air cooled blades having bases disposed in respective ones of said retention slots, said bases cooperating with said respective ones of said slots in defining a plurality of manifolds supplied with pressurized air from a first side of said wheel, an end seal for each of said manifolds at a second side of said wheel comprising, a seal ring having an annular planar portion and an integral cylindrical flange radially outboard of and perpendicular to said planar portion, means for axially clamping said seal ring planar portion against said second side of said wheel with a circle of contact radially inboard of each of said slots so that a 360° inboard seal is defined, means on said wheel and on each of said blade bases defining a continuous radially inwardly facing cylindrical shoulder disposed radially outboard of each of said manifolds, said flange being disposed radially inboard of and adjacent said cylindrical shoulder, a plurality of end plates supported on said wheel adjacent said second side for limited centrifugally induced radially outward displacement during rotation of said wheel, and means on each of said end plates defining a lug disposed adjacent to and inboard of said flange, said lugs being operative during centrifugally induced radially outboard displacement of said end plates to radially clamp said flange against said cylindrical shoulder and thereby provide a 360° seal radially outboard of each of said manifolds.

3. In a gas turbine rotor assembly including a wheel having a circumferential array of retention slots, a plurality of air cooled blades having bases disposed in respective ones of said retention slots, each of said bases cooperating with said respective ones of said retention slots in defining a plurality of manifolds supplied with pressurized air from a first side of said wheel, and a spacer disposed adjacent a second side of said wheel radially inboard of each of said manifolds and rotatable as a unit with said wheel, an end seal for each of said manifolds at said second side of said wheel comprising, a seal ring having an annular planar portion and an integral cylindrical flange disposed perpendicular to and radially outboard of said planar portion, said planar portion being disposed between said spacer and said wheel, means operative to axially clamp said spacer and said wheel thereby to tightly capture said planar portion therebetween so that contact is established between said seal ring and said wheel radially inboard of each of said manifolds and a 360° inboard seal is defined, means on said wheel and on each of said blade bases defining a continuous radially inwardly facing cylindrical shoulder disposed radially outboard of each of said manifolds, said flange being disposed radially inboard of and adjacent said cylindrical shoulder, a plurality of end plates supported on said wheel adjacent said second side and radially outboard of said spacer and cooperating in defining an annular barrier to passage of a motive fluid extending completely around said wheel, each of said end plates being supported on said wheel for limited centrifugally induced radially outward displacement during rotation of said wheel, and means on each of said end plates defining an integral lug having a shoulder disposed adjacent to and radially inboard of said cylindrical flange, each of said lugs being operative during centrifugally induced radially outward displacement of said end plates to radially clamp said flange between said cylindrical shoulder and said lug shoulders and thereby provide a 360° seal radially outboard of each of said manifolds.

* * * * *